United States Patent [19]

Cox

[11] Patent Number: 4,580,468

[45] Date of Patent: Apr. 8, 1986

[54] PIPE WRENCH

[76] Inventor: Terrence D. Cox, P.O. Box 222, Olney, Ill. 62450

[21] Appl. No.: 622,622

[22] Filed: Jun. 20, 1984

[51] Int. Cl.[4] ..... B25B 13/14

[52] U.S. Cl. ..... 81/138; 81/139; 81/143; 81/145

[58] Field of Search ..... 81/130 R, 130 A, 134, 81/138, 139, 142, 143, 145, 129, 356, 411, 328

[56] References Cited

U.S. PATENT DOCUMENTS

| | | | |
|---|---|---|---|
| 312,001 | 2/1885 | Meyers | 81/139 |
| 660,415 | 10/1900 | Carter | 81/356 |
| 666,433 | 1/1901 | Odegaard | 81/134 |
| 757,861 | 4/1904 | Carnes | 81/145 |
| 768,761 | 8/1904 | Larson | 81/138 |
| 793,257 | 6/1905 | Williams | 81/411 |
| 870,510 | 11/1907 | Hartridge et al. | 81/411 |
| 1,056,693 | 3/1913 | Krahulec | 81/328 |
| 1,201,521 | 10/1916 | Spain | 81/130 A |
| 1,278,590 | 9/1918 | Carr | 81/328 |
| 1,405,232 | 1/1922 | Landis et al. | 81/411 |
| 1,471,413 | 10/1923 | Palmeter | 81/145 |
| 1,643,002 | 9/1927 | Beszczak | 81/134 |
| 1,738,607 | 12/1929 | Patch | 81/356 |
| 1,781,940 | 11/1930 | Anderson | 81/356 |
| 2,369,346 | 2/1945 | Gearhart | 81/356 |
| 2,594,684 | 4/1952 | Rothe | 81/180 B X |

FOREIGN PATENT DOCUMENTS

| | | | |
|---|---|---|---|
| 496243 | 10/1978 | Australia | 81/139 |

*Primary Examiner*—Frederick R. Schmidt
*Assistant Examiner*—Debra S. Meislin
*Attorney, Agent, or Firm*—Harvey B. Jacobson

[57] ABSTRACT

A sliding jaw pipe wrench has a jaw adjustment mechanism comprising a longitudinally extending series of transverse recesses formed in one surface of an elongate shank on which the movable jaw of the wrench is formed. The shank is received in a retaining pocket in the wrench handle on which the stationary jaw is formed, and the handle includes a transverse locking pin for engagement in, and disengagement from the respective recesses to retain the movable jaw in position when engaged in a recess and allow the shank to be moved to adjust the jaws when disengaged from the recesses. The locking pin is operated by a trigger-like lever pivoted on the handle and connected to the locking pin by an elongate actuating rod. A spring engaging the lever urges the locking pin into engagement with the respective recesses.

17 Claims, 12 Drawing Figures

PIPE WRENCH

BACKGROUND OF THE INVENTION

This invention relates to sliding jaw wrenches, particularly pipe wrenches in which a movable jaw has a degree of freedom to rock or float relative to a stationary jaw, and the jaws are relatively inclined, in order to grip around a pipe or the like.

In wrenches of the sliding jaw type, the movable jaw commonly is formed on an elongate shank which is mounted for lengthwise movement, to adjust the jaw opening, on a wrench handle, which is formed with the stationary jaw, and a screw mechanism with a rotary actuator is commonly provided between the shank and the handle to effect adjusting movements of the movable jaw. In such wrenches, both hands may be needed to adjust the jaws, and the screw mechanism may be difficult to operate should dirt get in the threads, or should the operator's fingers be stiff or slippery.

The present invention provides a sliding jaw wrench having an alternative type of adjustment mechanism which is simpler to operate, and not as subject to the difficulties outlined above.

STATEMENT OF PRIOR ART

The following U.S. patents pertain to sliding jaw wrenches and the like having adjustment mechanisms other than screw-adjustment mechanisms for adjusting the jaw opening. None of these patents, however, discloses the features of the present invention. U.S. Pat. Nos.:

312,001, J. G. Meyers, Feb. 10, 1885
660,415, G. B. Carter, Oct. 23, 1900
666,433, N. Odegaard, Jan. 22, 1901
793,257, J. T. Williams, June 27, 1905
870,510, F. Hartridge et al, Nov. 5, 1907
1,056,693, J. Krahulec, Mar. 18, 1913
1,278,590, D. J. Carr, Sept. 10, 1918
1,405,232, A. L. Landis et al, Jan. 31, 1922
1,738,607, A. C. Patch, Dec. 10, 1929
1,781,940, L. De M. Anderson Nov. 18, 1930
2,369,346, R. E. Gearhart, Feb. 13, 1945

SUMMARY OF THE INVENTION

The invention provides a sliding jaw wrench, such as a pipe wrench, having a stationary jaw on an elongate wrench handle and a movable jaw on an elongate shank mounted on the handle for lengthwise movement to adjust the opening of the jaws, with a novel form of jaw adjustment mechanism. Thus, in accordance with the invention, the shank of the movable jaw is formed with a lengthwise series of recesses along one edge, and the wrench handle is provided with an adjustment linkage including a movable locking pin for receipt in a selected one of the recesses to lock the movable jaw in selected position, and for retraction from the recesses to release the movable jaw for adjustment, under the control of a sprung pivoted trigger-like lever mounted on the handle for operation by thumb or finger pressure, the lever being connected with the locking pin by an elongate actuating rod. The locking pin may be constrained to move between engaged and disengaged positions with respect to the recesses along a reaction surface defined by arcuate slots for guiding the pin, the slots being formed in laterally spaced wall portions of the handle. The handle may be formed of steel or aluminum, and in the latter case a hardened steel insert may be provided defining the locking pin guide slots.

A wrench in accordance with the invention can be adjusted with one hand, without a user having to release his or her grip on the wrench handle, simply by applying thumb or finger pressure on the sprung lever and flicking or otherwise moving the movable jaw to the required position. Further, the wrench may be readily dismantled for cleaning and the like and the locking pin may be replaced when worn.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF PREFERRED EMBODIMENTS

Figure 1:
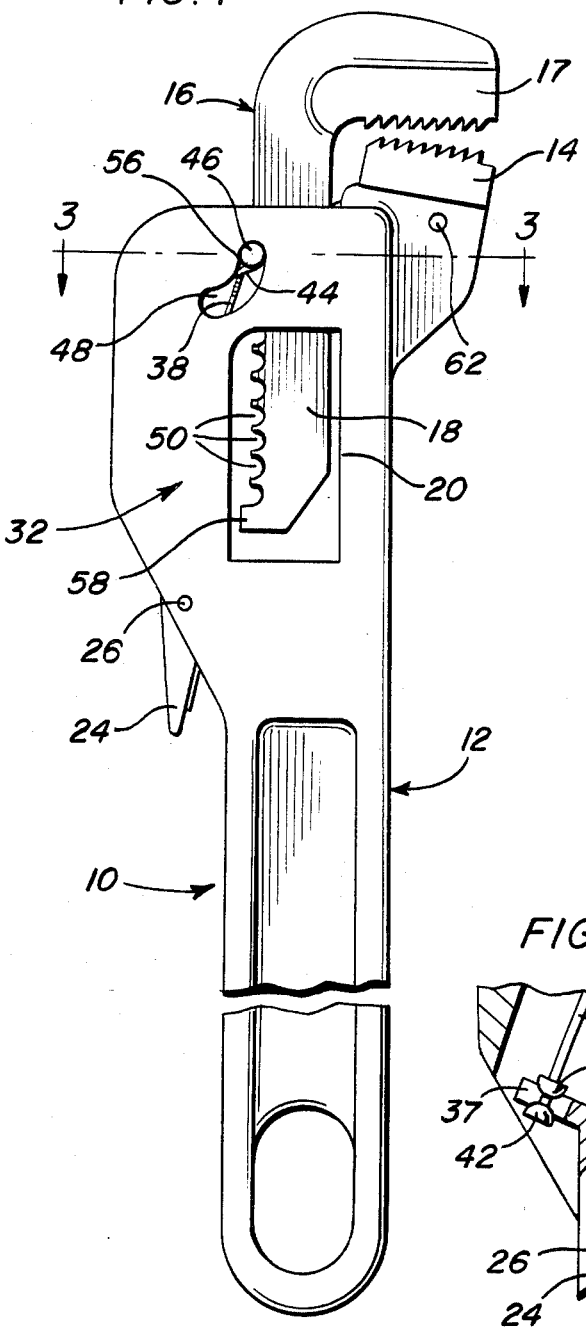
FIG. 1 is a side elevational view of a first form of sliding jaw pipe wrench in accordance with the invention.
Figure 2:
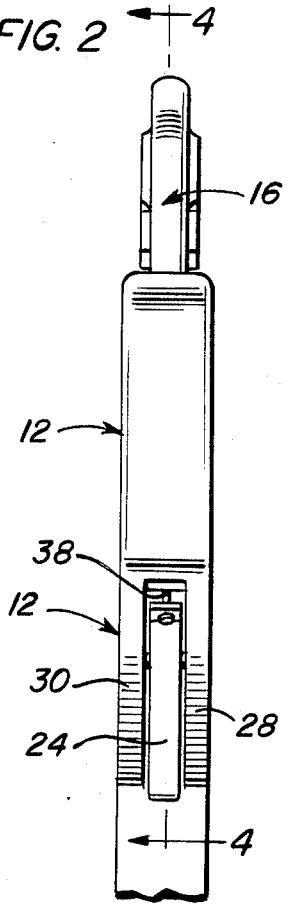
FIG. 2 is an end elevational view of an upper portion of the wrench.
Figure 6:
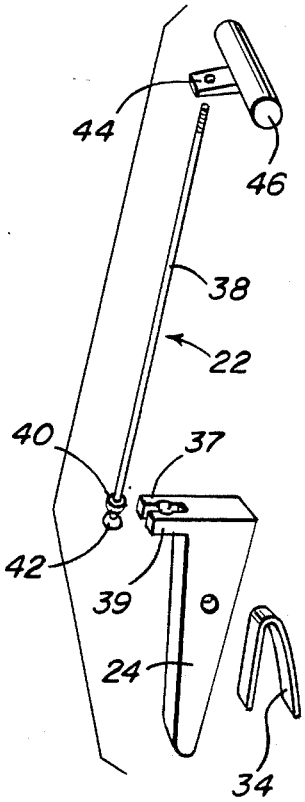
FIG. 6 is an exploded view of the jaw adjustment linkage.
Figure 5:
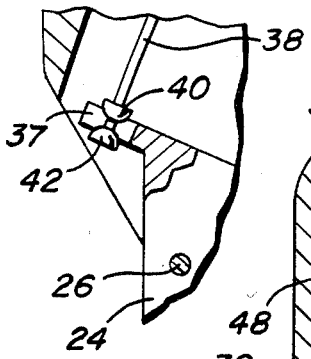
FIG. 5 is an enlarged sectional view of a part of the wrench showing components of a jaw adjustment linkage.

Referring initially to FIGS. 1–7, there is illustrated a sliding jaw-type pipe wrench 10 comprising a steel handle 12 provided at its upper end with a stationary hardened steel serated jaw insert 14, a movable member 16 comprising a movable jaw 17 formed at the end of an elongate shank 18, which is received in a pocket 20 in the upper portion of handle 12, and a releasable adjustment mechanism, generally indicated by reference 22, for retaining movable member 16 in selected position determining the degree of opening of the wrench jaws.

The adjustment mechanism includes a trigger-like lever 24 pivotally mounted on a pivot pin 26 spanning opposed walls 28, 30 of a slotted portion 32 of the handle, the lever 24 being urged outwardly of the handle by a yoke-like spring 34 with its respective arms seated in respective recesses in the side of the handle and the side of the lever member. At its upper end, the other end of the lever member has a slotted extension with arms 37, 39, which receive the lower end of an elongate rod 38 forming a further element of the jaw adjustment mechanism. Rod 38 has a pair of part-spherical collars 40, 42 secured thereon which embrace the arms 37, 39, with the rod extending between the arms, so as to allow for a degree of swiveling of the lever 24 relative to the rod. At its upper end, rod 38 is threaded into a tongue 44 on back of a transverse locking pin 46 which rides in arcuate slots 48 formed in the respective sidewalls 28, 30 of the handle. Locking pin 46 cooperates with shank 18 of the movable wrench jaw as described below.

Figure 4:
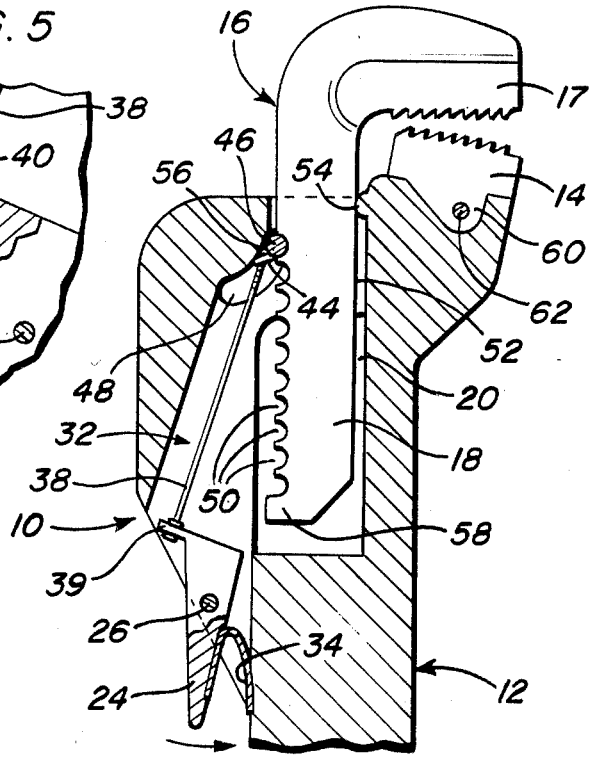
FIG. 4 is a sectional view on line 4—4 of FIG. 2.
Figure 3:
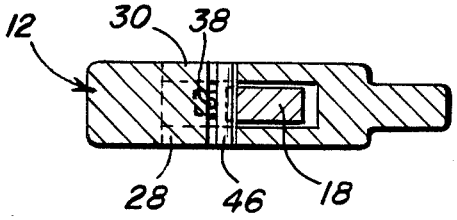
FIG. 3 is a sectional view on line 3—3 of FIG. 1.
Figure 8:
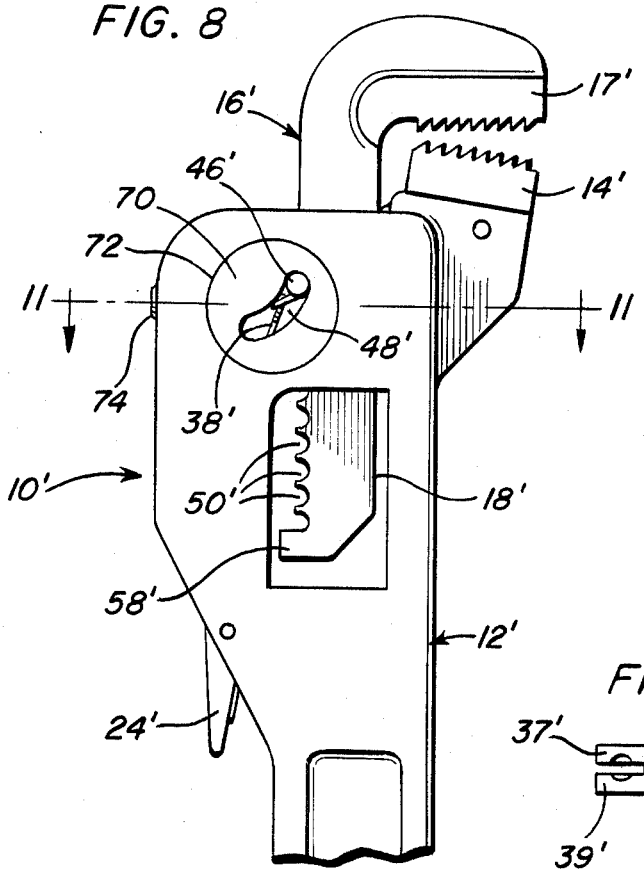
FIG. 8 is a side elevational view of the upper portion of a second form of sliding jaw pipe wrench in accordance with the invention.
Figure 9:
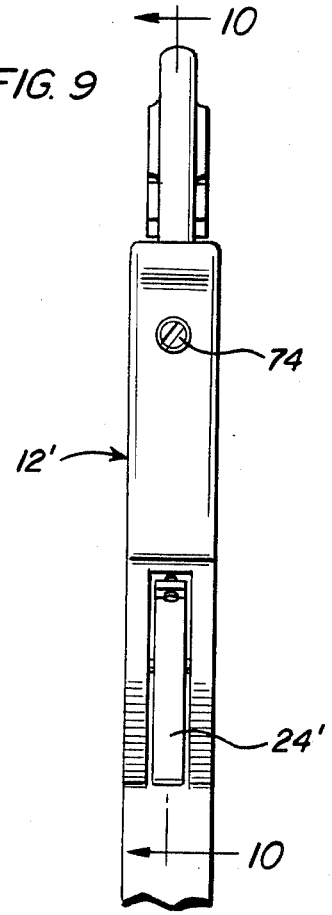
FIG. 9 is an end view elevational view of the wrench shown in FIG. 8.
Figure 12:
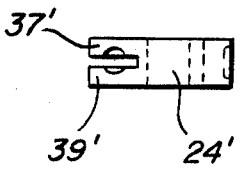
FIG. 12 is a plan view of a lever element of the jaw adjustment mechanism of the wrench shown in FIGS. 8–11.
Figure 10:
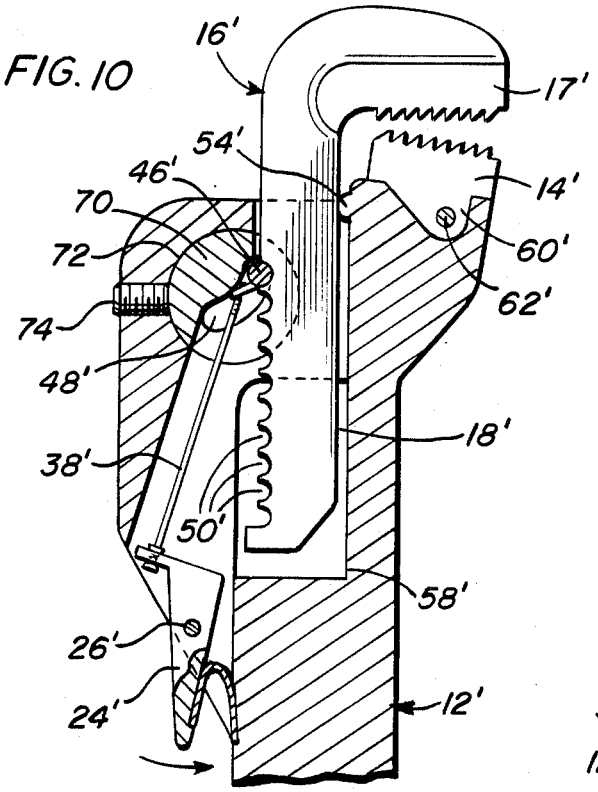
FIG. 10 is a sectional view on line 10—10 of FIG. 9.
Figure 11:
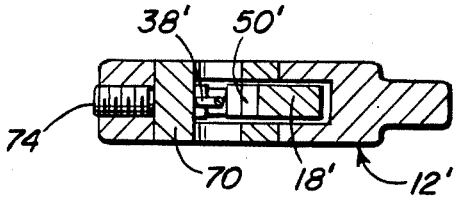
FIG. 11 is a sectional view on line 11—11 of FIG. 10.

Along its rear edge, shank 18 is provided with a longitudinal series of pin-receiving recesses 50 and the configuration of the adjustment mechanism is such that lever 24 being urged outwardly by spring 34, urges pin 46 to the top of slots 48 into a position in which the central portion of the pin is received in one of the recesses 50 to lock the movable jaw in longitudinally adjusted position relative to the stationary jaw (FIG. 4).

Forward edge 52 of shank 18 engages a nipple 54 on the interior of the handle, so that the movable jaw member has a degree of freedom to rock about the nipple 54 and pin 46, to facilitate gripping around a pipe. Also, it will be noted that the jaws are relatively inclined, as is customary in pipe wrenches. In applying torque to a pipe, forces exerted on pin 46 are resisted by arcuate wall 56 of the handle defining slots 48.

Figure 7:
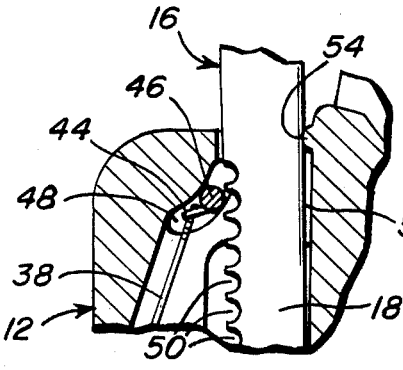
FIG. 7 is a view similar to FIG. 4 showing the adjustment linkage in a jaw-releasing position.

When adjustment of the degree of jaw opening is required, lever member 24 is depressed by thumb or finger pressure against the force of spring 34, causing pin 46 to be pulled down slots 48 by rod 38 and out of engagement with the respective shank recess 50, thus releasing the shank and allowing the movable jaw to be flicked in the hand or otherwise moved to the required position (FIG. 7). A projection 58 on the bottom of shank 18 adjacent the endmost recess 50 which defines the maximum jaw opening, prevents the shank from moving out of the handle past pin 46. However, the movable jaw member can be removed from the wrench if required, for example, should pocket 20 become clogged with dirt, by pulling up on and then tilting the movable jaw while depressing lever member 24. Also, pin 46 can be removed for replacement, if required through wear, for example, by removing rod 38 from arms 37, 39 of the lever member, unthreading the rod from tongue 44, and dropping the pin through one of the slots 48.

The stationary jaw insert 14 has a tongue 60 fitting in a groove (not shown) in handle 12, and held in place by a removable transverse pin 62 which allows for replacement of the stationary jaw.

The wrench 10' shown in FIGS. 8–12 is similar in design and operation to that shown in FIGS. 1–7, except that handle 12' is made of aluminum. Accordingly, a circular hardened steel slotted insert 70 is provided defining the guide slots 48' for locking pin 46' so as to provide a reaction surface for the pin of adequate hardness. Insert 70 may be held in place in a suitable opening 72 formed in the handle by a locking screw 74. Wrench 10' is in other respects alike in construction and operation to wrench 10 previously described.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A sliding jaw-type wrench comprising a wrench handle provided with a stationary jaw, a movable jaw formed on an elongate shank mounted on the wrench handle for lengthwise movement to adjust the degree of opening of the jaws, and an adjustment mechanism for controlling the position of the shank with respect to the handle, wherein the adjustment mechanism comprises a longitudinal extending series of locking recesses formed on the shank, a locking pin fitting between the shank and a surface of the handle for movement into engagement with a selected one of said recesses to hold the shank in position, and out of engagement with the recesses to release the shank for adjustment, and a linkage for moving the locking pin into and out of engagement with the respective recesses including a pivoted lever member mounted on the wrench handle for pivotal movement by thumb or finger pressure, and an actuating rod connected between the lever and the locking pin for translating pivotal movements of the lever into movement of the locking pin into and out of engagement with the respective recesses, wherein the shank is mounted in a pocket of the wrench handle having a front wall formed with a nipple for engaging a front surface of the shank, the recesses being formed along a rear surface of the shank, whereby the shank can rock in the pocket on the nipple and locking pin for facilitating gripping of a pipe and the like between the jaws.

2. The invention of claim 1 wherein the locking pin is mounted for movement into and out of engagement with the respective recesses in slots defined in laterally spaced walls of the wrench handle.

3. The invention of claim 2 wherein the wrench handle includes a hardened metal insert defining said walls and slots.

4. The invention of claim 3 wherein the insert is of circular, disc-like form fitting in a circular opening in the handle, and clamped in position by a locking screw threaded into the handle and engaging the periphery of the insert.

5. The invention of claim 1 including spring means connected between the handle and the lever member for biasing the lever member to a position urging the locking pin toward engagement in a respective one of the shank recesses.

6. The invention of claim 5 wherein the spring means comprises a yoke-like spring having respective arms fitting in recesses in confronting surfaces of the handle and lever member for urging an operating limb of the lever member outwardly of the handle.

7. The invention of claim 2 wherein the actuating rod has a releasable connection with the locking pin for removal of the locking pin through one of said slots.

8. The invention of claim 1 wherein the lengthwise series of recesses terminates in an endmost recess defining the maximum opening of the wrench jaws, and the shank has a projection adjacent said endmost recess for engagement with the locking pin to deter separation of the shank from the handle.

9. The invention of claim 1 wherein the stationary jaw is formed on an insert removably mounted on the wrench handle.

10. The invention of claim 9 wherein the insert includes a tongue fitting in a corresponding groove in the handle with a transverse retainer pin holding the insert and handle together.

11. A sliding jaw-type wrench comprising a wrench handle provided with a stationary jaw, a movable jaw formed on an elongate shank mounted on the wrench handle for lengthwise movement to adjust the degree of opening of the jaws, and an adjustment mechanism for controlling the position of the shank with respect to the handle, wherein the adjustment mechanism comprises a longitudinal extending series of locking recesses formed on the shank, a locking pin fitting between the shank and a surface of the handle for movement into engagement with a selected one of said recesses to hold the shank in position, and out of engagement with the recesses to release the shank for adjustment, and a linkage for moving the locking pin into and out of engagement with the respective recesses including a pivoted lever member mounted on the wrench handle for pivotal movement by thumb or finger pressure, and an actuating rod connected between the lever and the locking pin for translating pivotal movements of the lever into movement of the locking pin into and out of engagement with the respective recesses, wherein the actuating rod has a swivel connection with the lever member at one end of the rod, the other end of the rod is connected with a tongue extending from the locking pin, and the swivel connection comprises a pair of spaced, part-spherical collars on the actuating rod embracing a slotted arm portion of the lever member between the arms of which a portion of the rod between the collars is fitted.

12. A sliding jaw wrench comprising a wrench handle, a stationary jaw on the wrench handle, an elongate shank formed with a movable jaw, the shank being mounted for movement in a pocket formed in the handle to adjust the degree of opening of the jaws, a longitudinally extending series of transverse recesses formed along one edge of the shank, a transverse locking pin mounted in the handle for movement into and out of engagement with respective ones of said recesses for respectively retaining the shank in position and releasing the shank for adjustment of the jaws, biasing means urging the locking pin toward engagement in the respective recess, and release means for the locking pin including a trigger-like member on the wrench handle operated by thumb or finger pressure, and linkage means connected between the trigger-like member and the locking pin, wherein the handle has a nipple formed on a wall thereof defining the pocket, the nipple being adapted to engage an edge of the shank opposite the edge defining said recesses to allow a rocking movement of the shank about the nipple and locking pin for clamping engagement of the jaws around a pipe.

13. The invention of claim 12 wherein the trigger-like member comprises a lever member pivotally mounted on the handle, and the biasing means includes a spring urging one limb of the lever member outwardly of the handle for engagement by an operator.

14. The invention of claim 13 wherein the linkage means comprises an elongate rod connected between the locking pin and another limb of the lever member.

15. The invention of claim 14 wherein the rod extends through an opening defined by transversely spaced walls of the wrench handle, said walls further defining arcuate slots for guiding the locking pin into and out of engagement with the respective recesses.

16. The invention of claim 15 wherein the handle is formed of aluminum or like lightweight material, and includes an insert of hardened material defining portions of the respective walls including said slots.

17. A sliding jaw wrench comprising a wrench handle, a stationary jaw on the wrench handle, an elongate shank formed with a movable jaw, the shank being mounted for movement in a pocket formed in the handle to adjust the degree of opening of the jaws, a longitudinal series of transverse part-circular recesses formed along one edge of the shank, a transverse circular-section locking pin mounted in the handle for movement into and out of engagement with respective ones of said recesses for respectively retaining the shank in position and releasing the shank for adjustment of the jaws, actuating means associated with the handle for moving the locking pin, and a nipple formed on a wall of the handle defining the pocket for engaging an opposite edge of the shank, and for for providing rocking of the shank in the pocket facilitating gripping of a workpiece between the jaws.

* * * * *